US007273392B2

(12) United States Patent
Fields

(10) Patent No.: US 7,273,392 B2
(45) Date of Patent: Sep. 25, 2007

(54) UNIVERSAL ELECTRICAL MODULE

(76) Inventor: Dan Fields, 111 N. Church St., Lodi, CA (US) 95241

( * ) Notice: Subject to any disclaimer, the term of this patent is extended or adjusted under 35 U.S.C. 154(b) by 0 days.

(21) Appl. No.: 11/191,835

(22) Filed: Jul. 28, 2005

(65) Prior Publication Data

US 2006/0025012 A1 Feb. 2, 2006

Related U.S. Application Data

(60) Provisional application No. 60/592,256, filed on Jul. 29, 2004.

(51) Int. Cl.
*H01R 13/60* (2006.01)

(52) U.S. Cl. ..... 439/535; 174/53

(58) Field of Classification Search ..... 439/107, 439/535; 174/53
See application file for complete search history.

(56) References Cited

U.S. PATENT DOCUMENTS 3,609,647 A * 9/1971 Castellano ..... 439/535
3,922,478 A * 11/1975 Perkey ..... 174/53
3,970,772 A * 7/1976 Ballard ..... 174/53
5,936,199 A * 8/1999 Lutz ..... 174/53
6,441,304 B1 * 8/2002 Currier et al. ..... 174/53
6,530,806 B2 * 3/2003 Nelson ..... 439/528
6,767,245 B2 * 7/2004 King ..... 439/535
6,827,602 B2 * 12/2004 Greene et al. ..... 439/490
6,945,815 B1 * 9/2005 Mullally ..... 439/535

* cited by examiner

*Primary Examiner*—Thanh-Tam Le
(74) *Attorney, Agent, or Firm*—Richard D. Clarke

(57) ABSTRACT

In one embodiment, a universal electrical module is provided that facilitates the quick and safe installation of different types of electrical devices in an electrical box by enabling a technician to simply insert prongs extending from the electrical devices into matching slots on a first face of the universal electrical module. The universal electrical module is connected to the hot, ground and neutral wires of the building circuit by means of a bus on a second face of the module, and may be produced in different sizes to support one or more electrical devices. Additionally, meter reading slots may be provided on the first face to enable meter reading from the front face of the module. In another embodiment, an electrical device is provided that comprises a plurality of prongs extending from the device, wherein each of the prongs is structured to mate with a slot on an electrical module.

15 Claims, 15 Drawing Sheets

180
183

182
181
183

186
187
185

184
189
188

190
191
192
193
194

190
180

195
196
197
198
199

200
202
201
203

195
205
214
218
216

209
212
205
210

206
207
208
204

206
204

UNIVERSAL ELECTRICAL MODULE

CROSS-REFERENCE TO RELATED APPLICATIONS

The present patent application claims priority to provisional patent application Ser. No. 60/592,256 filed on Jul. 29, 2004 and titled "Universal Electrical Module."

BACKGROUND OF THE INVENTION

1. Field of the Invention

The present invention relates to a universal electrical module that improves ease and speed of installation of electrical devices during building construction. More specifically, the present invention relates to a universal electrical module that facilitates the installation of different types of an electrical device by enabling a technician to simply insert prongs that extend from each of the electrical devices into matching slots on the universal electrical module.

2. Description of Related Art

In the building industry, electrical boxes are typically installed during the framing of the building structure. Conduits such as electrical wires are drawn to the electrical boxes after the boxes are installed and connect the electrical boxes with each other and with a power disconnect, such as a circuit breaker. Instead, the individual electrical devices are lodged in the electrical boxes only after the wallboards are applied to the framing members. Such devices include single pole switches, three way switches, four way switches, and receptacles, which must all conform to U.S. building regulations related both to device construction and device installation.

The installation of each electrical device is a laborious task that is generally performed by hand by a trained electrician. As a building contains different types of electrical devices, each type of device must be connected to different connector wires inside the electrical box in order to operate properly, and the unused wires remaining in the electrical box are typically spliced together with a WIRE-NUT® brand twist on wire connector or similar components.

At the end of the installation process, all the wires within the electrical box are compressed inside the box by pushing the electrical device into the box. Power is prevented from flowing within the building circuit during the installation process, in order to protect the installation technicians, and is eventually released into the building circuit when the installation of the electrical devices is completed and the circuit is closed.

Therefore, there is a need to reduce the amount of handwork required to install electrical devices and to splice and connect wires after wallboard application.

There is also a need to reduce the level of skill required for the installation of electrical devices, and for the change-over from one type of device to another.

There is a further need to generate a flow of power as early as possible during the construction process, in order to have easy access to power.

There is an additional need to be able to install electrical devices without interrupting the flow of power once power has been released into the circuit.

BRIEF SUMMARY OF THE INVENTION

In one embodiment, a universal electrical module is provided that facilitates the quick and safe installation of different types of electrical devices in an electrical box by enabling a technician to simply insert prongs extending from the electrical devices into matching slots on a first face of the universal electrical module. The universal electrical module is connected to the hot, ground and neutral wires of the building circuit by means of a bus on a second face of the module, and may be produced in different sizes to support one or more electrical devices. Additionally, meter reading slots may be provided on the first face to enable meter reading from the front face of the module.

In another embodiment, an electrical device is provided that comprises a plurality of prongs extending from the device, wherein each of the prongs is structured to mate with a slot on an electrical module.

In still another embodiment, a method is provided for making a universal electrical module that comprises the steps of providing a housing having a first face with a plurality of slots and a second face with a bus and a plurality of ports; of causing each of the slots to create contact with a bus portion or with one of the ports; and of providing a retention system that extends from the housing and that is shaped to retain the universal electrical module within an electrical box. Each of the slots is structured for mating with a prong that extend from an electrical device.

A primary advantage of the present invention to significantly reduce the time required to install electrical devices in a building after wallboard application.

Another advantage of the present invention is to reduce the time and skill level required to install electrical devices in a building, or for changing over from one type of device to another.

A further advantage of the present invention is to provide for the availability of power in a building structure during the framing stage without undue risk to the working personnel.

Yet another advantage of the present invention is to enable a safer installation of electrical devices during building construction or remodeling.

Still another advantage of the present invention is to provide for single or multiple gang modules having a single point of connection to a power, neutral, and ground source.

These and other advantages of the present invention will become apparent from a reading of the following description, and may be realized by means of the instrumentalities and combinations particularly pointed out in the appended claims.

BRIEF DESCRIPTION OF THE SEVERAL VIEWS OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

FIGS. 1A-1C illustrate a single-gang module in one embodiment of the invention, wherein FIG. 1A is a front view, FIG. 1B is a left side view, and FIG. 1C is a rear view.

FIGS. 4A-4B illustrate a single pole switch according to one embodiment of the invention, wherein FIG. 4A is a right side view and FIG. 4B is a rear view.

FIGS. 5A-5B illustrate the single-gang module of FIGS. 1A-1C, wherein FIG. 5A is a front view and FIG. 5B is a rear view.

FIGS. 6A-6H show a three-way switch assembly, wherein FIG. 6A is a right view of a switch according to one embodiment of the present invention, FIG. 6B is a rear view of the switch of FIG. 6A, FIG. 6C is a front view of a single-gang module according to an embodiment of the present invention, FIG. 6D is a rear view of the module of FIG. 6C, FIG. 6E is a rear view of a single-gang module according to an embodiment of the present invention, FIG. 6F is a front view of the module of FIG. 6E, FIG. 6G is a rear view of a switch having the same construction as FIG. 6B, and FIG. 6H is a right side view of the switch of FIG. 6G.

FIGS. 7A-7B illustrate a single receptacle according to one embodiment of the present invention, wherein FIG. 7A is a front view and FIG. 7B is a rear view, and FIGS. 7C-7D illustrate the single gang module of FIGS. 1A-1C, wherein FIG. 7C is a front view and FIG. 7D is a rear view.

FIGS. 8A-8B illustrate a duplex receptacle according to one embodiment of the present invention, wherein FIG. 8A is a front view and FIG. 8B is a rear view, and FIGS. 8C-8D illustrate the single gang module of FIGS. 1A-1C, wherein FIG. 8C is a front view and FIG. 8D is a rear view.

FIGS. 10A-10B illustrate a half switch receptacle according to one embodiment of the present invention, wherein FIG. 10A is a front view and FIG. 10B is a rear view, and FIGS. 10C-10D illustrate the single gang module of FIGS. 1A-1C, wherein FIG. 10C is a front view and FIG. 10D is a rear view.

FIGS. 11A-11B illustrate a single pole/receptacle according to one embodiment of the present invention, wherein FIG. 11A is a front view and FIG. 11B is a rear view, and FIGS. 11C-11D illustrate the single gang module of FIGS. 1A-1C, wherein FIG. 11C is a front view and FIG. 11D is a rear view.

FIGS. 12A-12L show a four-way switch assembly, wherein FIG. 12A is a right view of a switch according to one embodiment of the present invention, FIG. 12B is a rear view of the switch of FIG. 12A, FIG. 12C is a front view of a single-gang module according to an embodiment of the present invention, FIG. 12D is a rear view of the module of FIG. 12C, FIG. 12E is a rear view of a single-gang module according to an embodiment of the present invention, FIG. 12F is a front view of the module of FIG. 12E, FIG. 12G is a rear view of a switch according to a different embodiment of the present invention, FIG. 12H is a left side view of the switch of FIG. 12G, FIG. 12I is a rear view of a single-gang module according to an embodiment of the present invention, FIG. 12J is a front view of the module of FIG. 12I, FIG. 12K is a rear view of the same switch as in FIG. 12B but in an upside-down position, and FIG. 12L is a right side view of the switch of FIG. 12K.

FIGS. 13A-13D illustrate a two-gang electrical module according to on embodiment of the present invention, wherein FIG. 13A is a front view, FIG. 13B is a right side view, FIG. 13C is a rear view, and FIG. 13D illustrates a cross-section of the module of FIGS. 13A-13C as seen from a front viewpoint.

FIGS. 14A-14D illustrate a three-gang electrical module according to on embodiment of the present invention, wherein FIG. 14A is a front view, FIG. 14B is a right side view, FIG. 14C is a rear view, and FIG. 14D illustrates a cross-section of the module of FIGS. 13A-13C as seen from a front viewpoint.

FIGS. 15A-15D illustrate a four-gang electrical module according to on embodiment of the present invention, wherein FIG. 15A is a front view, FIG. 15B is a right side view, FIG. 15C is a rear view, and FIG. 15D illustrates a cross-section of the module of FIGS. 15A-15C as seen from a front viewpoint.

DETAILED DESCRIPTION OF THE INVENTION

Detailed descriptions of embodiments of the invention are provided herein. It is to be understood, however, that the present invention may be embodied in various forms. Therefore, the specific details disclosed herein are not to be interpreted as limiting, but rather as a representative basis for teaching one skilled in the art how to employ the present invention in virtually any detailed system, structure, or manner.

Figure 1C:
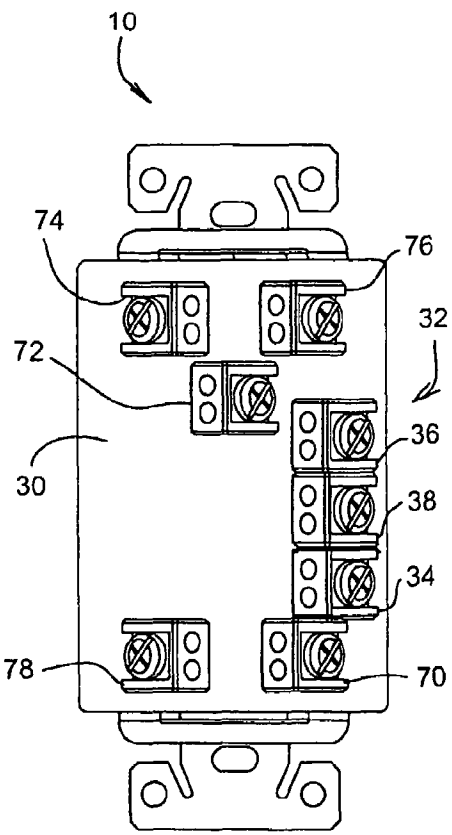
Figure 1B:
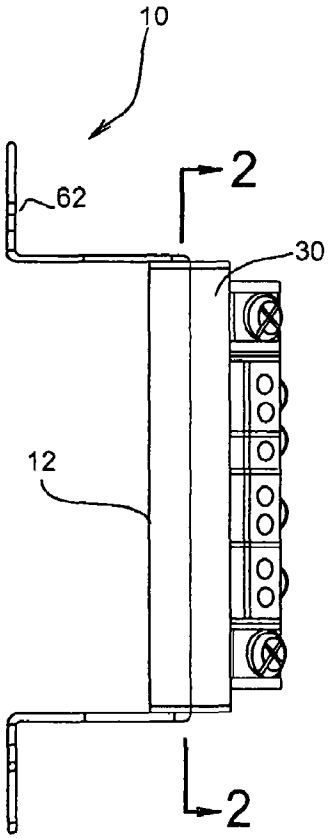
Figure 1A:
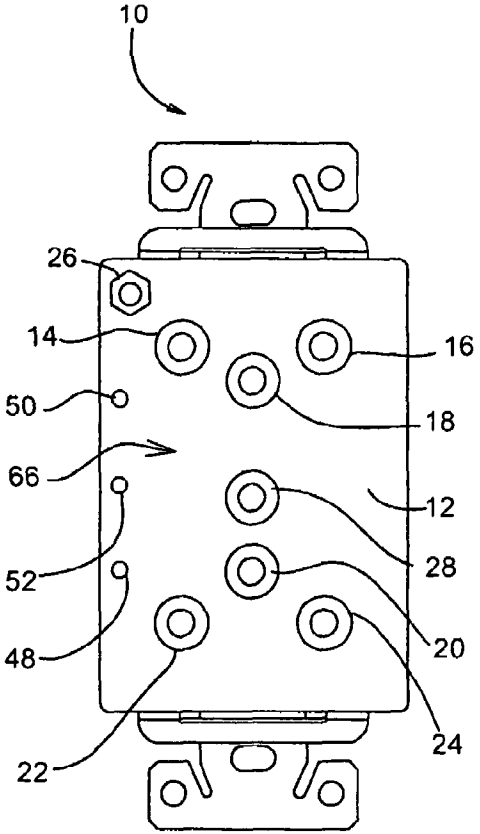
Figure 3:
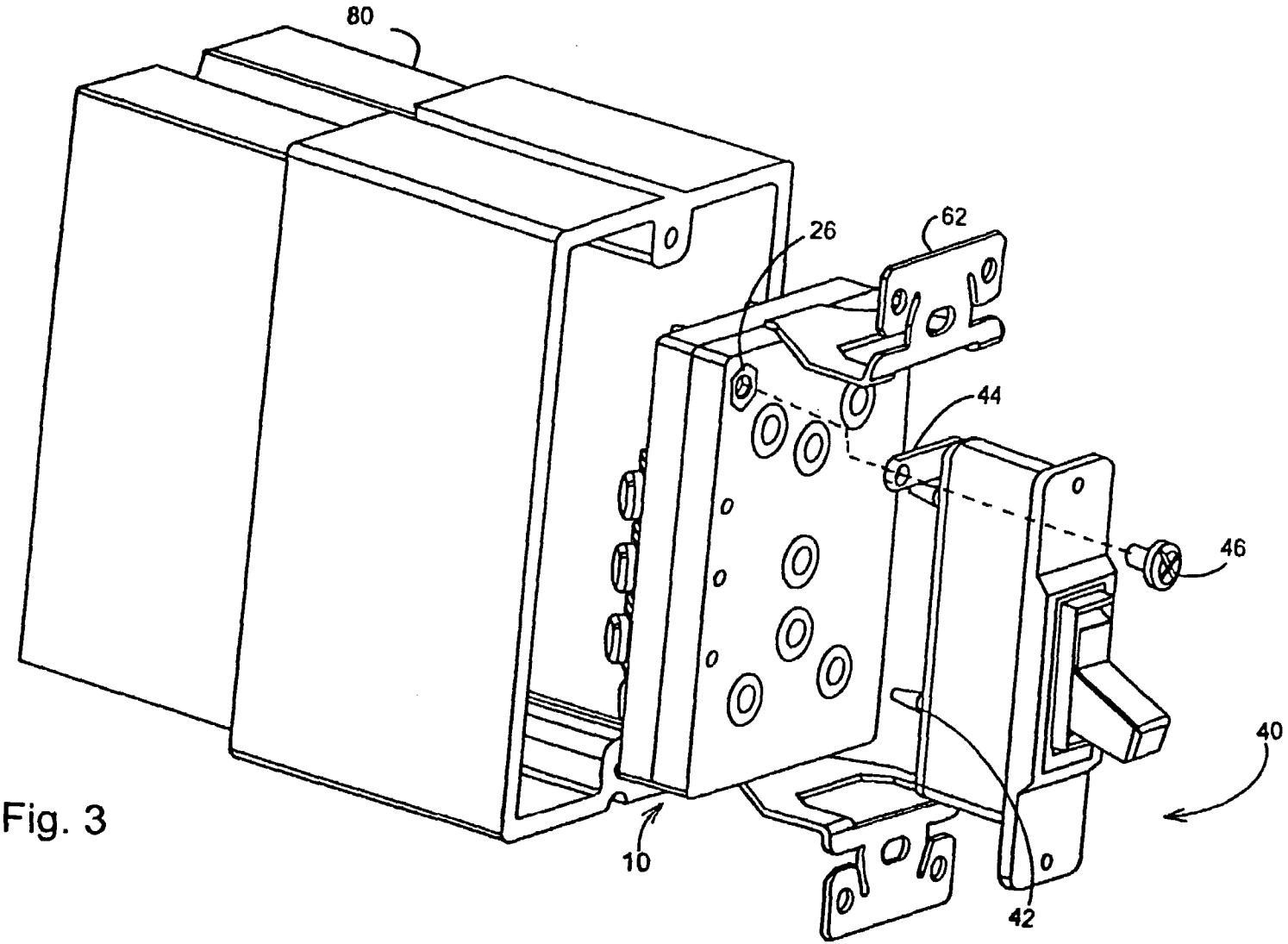
FIG. 3 is an exploded view of the assembly of a single pole switch with the single-gang module of FIGS. 1A-1C and with an electrical box.

In accordance with one embodiment of the present invention, there are shown in FIGS. 1A-1C different views of a single gang universal electrical module 10 that is designed for positioning inside an electrical box. More specifically, FIG. 1A illustrates a front view of module 10, FIG. 1B illustrates a left side view, and FIG. 1C illustrates a rear view.

Module 10 comprises a front face 12, a rear face 30, and two retention plates 62 enabling the permanent positioning of module 10 into an electrical box. A plurality of slots, indicated with reference numerals 14, 16, 18, 20, 22, 24, 26 and 28, are located on front face 12, wherein slots 20, 26, and 28 are connected to a bus 32 on rear face 30, and slots 14, 16, 18, 22, and 24 are connected to ports 70, 72, 74, 76, and 78 also on rear face 30. More specifically, slot 20 is connected to a power-carrying ("hot") portion 34 of first bus 32; slot 26 is connected to a ground portion 36 of first bus 32; and slot 28 is connected to a neutral portion 38 of first bus 32, and all the remaining slots are connected to a plurality of ports on rear face 30 as follows: slot 14 to port 76; slot 16 to port 74; slot 18 to port 72; slot 22 to port 70; and slot 24 to port 78. Among the slots connected to hot portion 34, slot 18 is designed as a "load" slot, slot 20 as a "power" or "line" slot, slot 26 as a "ground" slot, and slots 14, 16, 22, and 24 as "travelers," because ports 70-78 are intended for connection with "traveler" wires. The relative positions of bus 32 and of ports 70-78 enable a comfortable access of an electrician's screwdriver during installation.

One skilled in the art will recognize that the terms "slots" and "prongs" employed in this written description and in the drawings herein are only exemplary of two types of contacts, and that other types of contacts, including contacts of shorter depths, fall within the scope of the present invention. In particular, contacts of different depths may be desired to conform to building regulations in certain areas where the invention is practiced.

In accordance with a further aspect of the present embodiment, bus 32 may be tested while an electrician faces front face 12 (for instance, after the universal electrical module has been installed in the electrical box). By accessing meter reading row 66 on first face 12, bus portions 34, 36, and 38 can be accessed from front face 12 and meter readings can be obtained. More specifically, hot meter slot 48 enables an electrician to test hot portion 34, while neutral meter slot 52 enables testing of neutral portion 38, and ground meter slot 50 enables testing of neutral portion 36.

The configuration of slots 14-28 enable the installation of different types of electrical devices on module 10. For the purpose of this description, "electrical devices" are defined as devices interconnected by a plurality of electrical conduits, for instance, by electrical wires that supply power from a power disconnect such as a circuit breaker. Different types of electrical devices are well known to one skilled in the art and comprise, among others, single pole switches, three way switches, four way switches, single receptacles, duplex receptacles, half switch receptacles, and single pole/receptacles.

The configuration of slots 14-28 shown in FIG. 1A is exemplary of one design choice. Slots 14-28 may also be arranged according to other design choices, all achieving the same purpose as the configuration shown in FIG. 1A. Further, slots 14-28 are shown in FIG. 1A as cylindrical in shape with round cross sections; however, slots 14-28 may be designed with a variety of different shapes, for instance, may be cylindrical with rectangular or star shaped cross-sections, or may be hemispherical. Likewise, the configuration of slot 26 shown in FIG. 1A is only exemplary of one of different design choices available for a ground slot.

The following Table I exemplifies how a few, exemplary electrical devices that may connect to the different slots illustrated in FIG. 1.

TABLE I

| Type of Electrical Device | Slots Connections |
|---|---|
| Single Pole Switch | 18 and 20 |
| Three Way Switch | 14, 16, and 20 |
| Second Three Way Switch | 22, 24, and 18 |
| Four Way Switch | 14, 16, 22, and 24 |
| Receptacle | 20, 28, and 26 |

Figure 2:
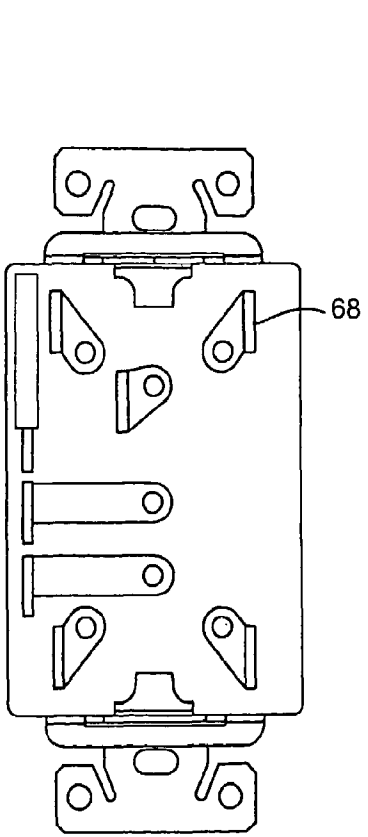
FIG. 2 illustrates a cross-section of the embodiment of FIGS. 1A-1C, as seen from a front viewpoint.

Turning now to FIG. 2, there is shown a cross-section of module 10, as seen from the same side as a front side viewpoint. A plurality of contact plates 68 provide an electrical connection from the slots on front face 12 to the corresponding elements on rear face 30. The individual shapes of contact plates 68 may vary depending to the relative positions of each slot on front face 12 and of the corresponding element on rear face 30.

Figure 5B:
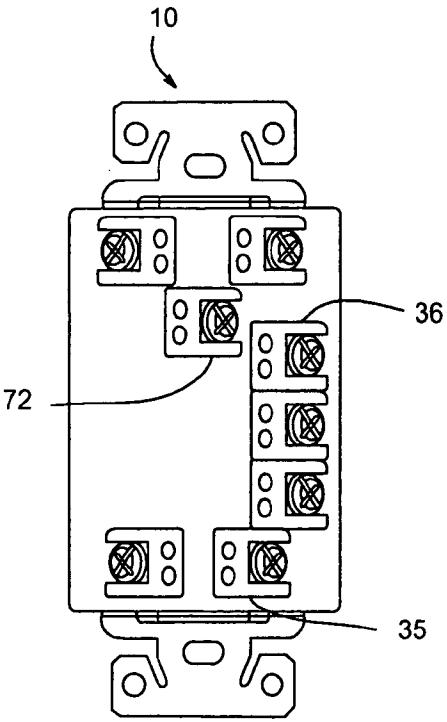
Figure 5A:
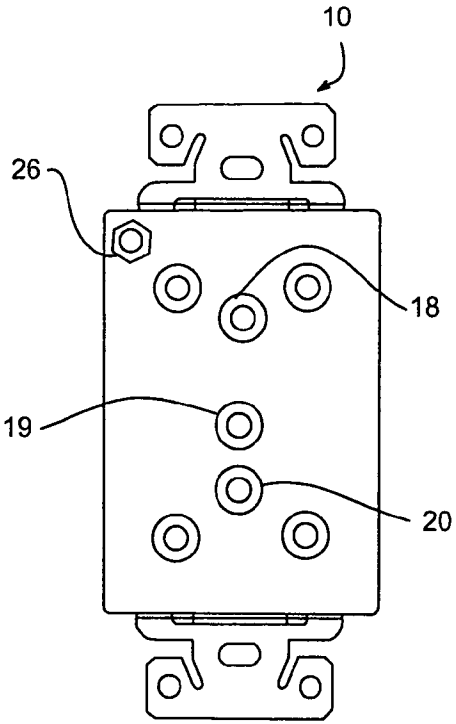
Figure 4B:
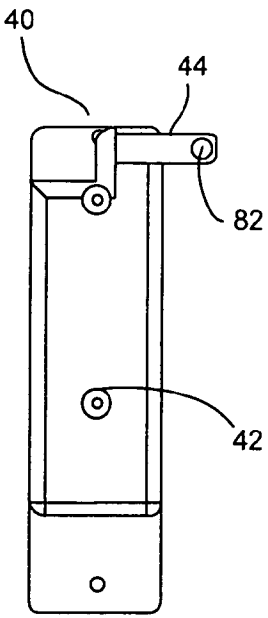
Figure 4A:
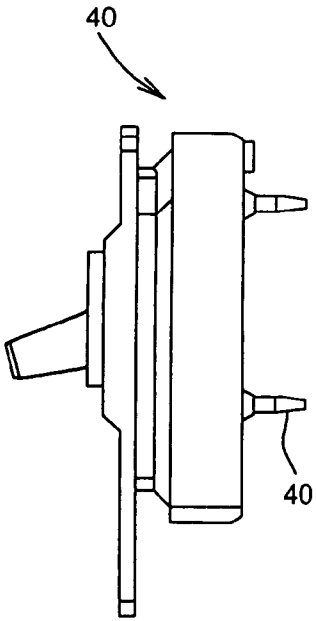

The operation of universal electrical module 10 may be better understood upon reference to FIGS. 3, 4A-B, and 5A-B, which illustrate the connection of a single pole switch 40 to single gang module 10. FIGS. 5A and 5B are the same as FIGS. 1A and 1C, and are reproduced here for the convenience of the reader.

Prongs 42 extend from single pole switch 40 and mate with slots 18 and 20, thereby enabling a proper functioning of single pole switch 40. More particularly, slot 18 operates as a "load" slot connected to port 72, while slot 20 operates as a "line" slot connected to hot portion 34. In the illustrated application, the ground prong of single pole switch 40 is plate-shaped, and is connected to ground slot 26 by means of a screw to eventually connect single pole switch 40 to ground portion 36. It should be noted that a single pole switch may also be configured to have two prongs arranged to mate with"load" slot 20 and with "neutral" slot 19.

Because module 10 is affixed to an electrical box 80 by means of retention plates 62, and because single pole switch 40 is affixed to module 10, single pole switch 40 becomes also affixed to electrical box 80.

FIGS. 6A-6H show a different application related to of a 3-way switch system employing an electrical module constructed according to the present embodiment of the universal electrical module. A first switch 84 (shown in FIG. 6A from a right side view and in FIG. 6B from a rear view) comprises three prongs, that are indicated by reference numerals 86, 88, and 90 and that extend from the rear face of switch 84. Prongs 86, 88, and 90 mate with slots 92, 94, and 96 on the front face of a module 98, wherein slot 92 and 94 are "travelers" and slot 96 is a "line" slot. In turn, slot 92 is connected to a port 100, slot 94 to a port 104, and slot 96 to a hot portion 106.

Figures 6A, 6B, 6C, 6D, 6E, 6F, 6G, 6H:
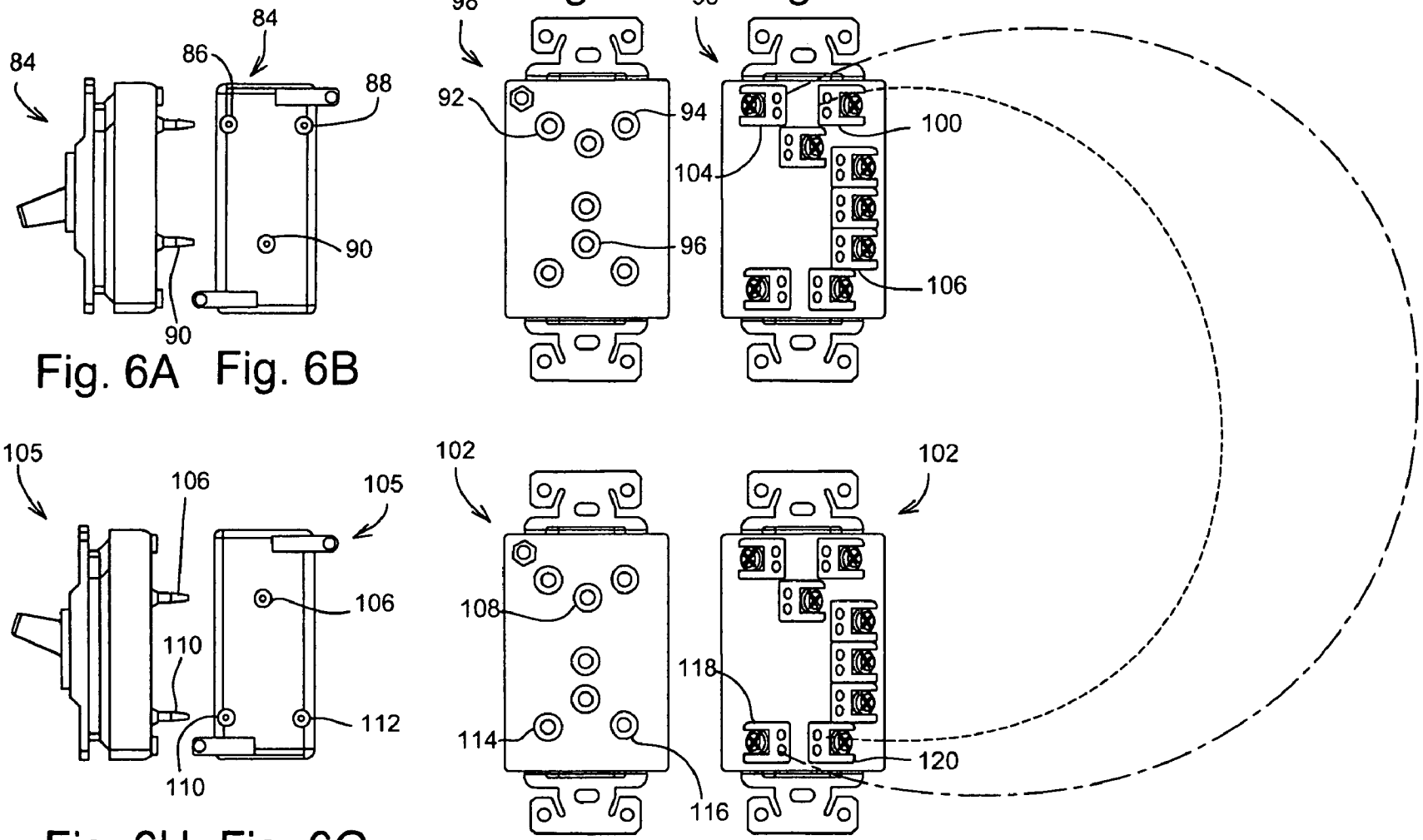
Figure 7D:
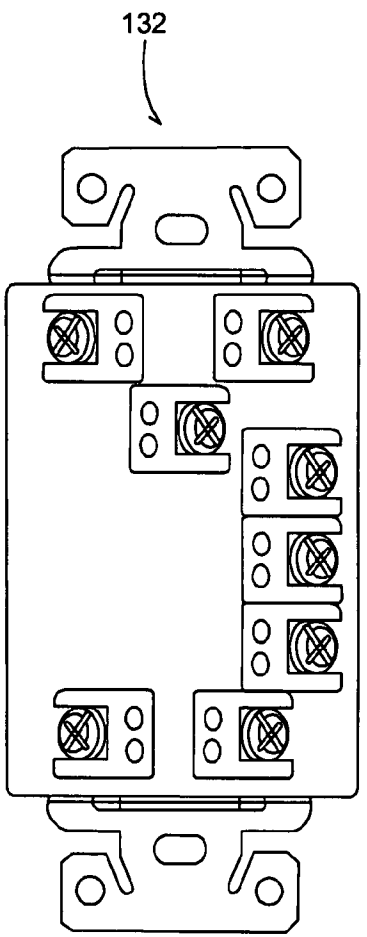
Figure 7C:
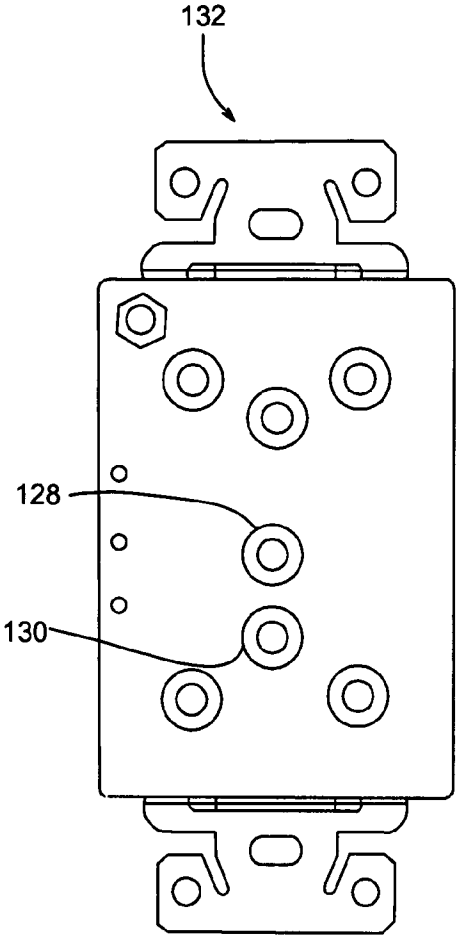
Figure 7B:
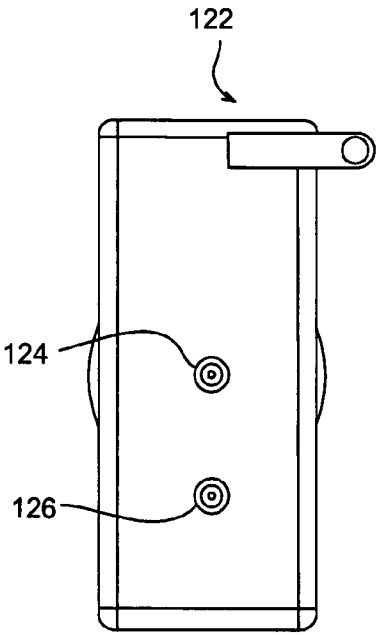
Figure 7A:
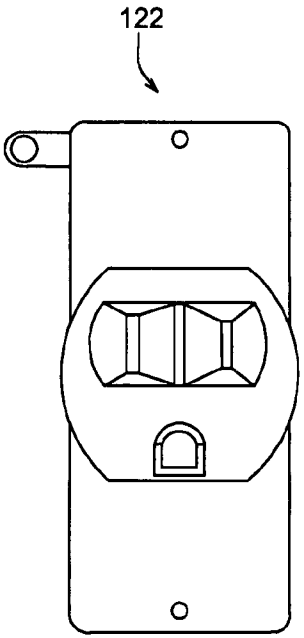
Figure 8D:
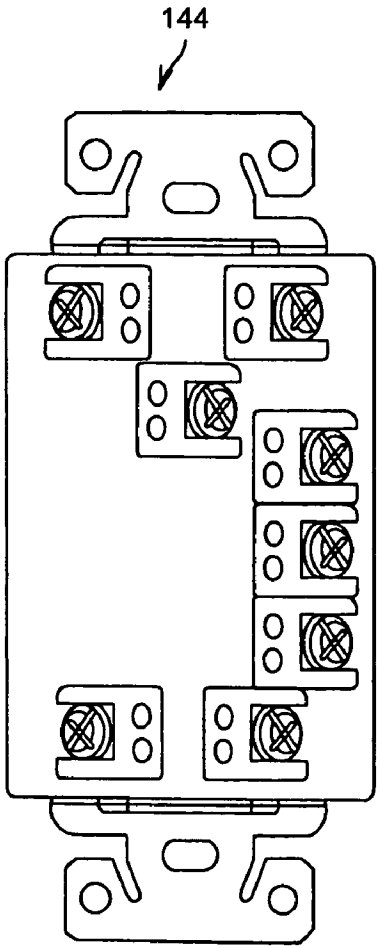
Figure 8C:
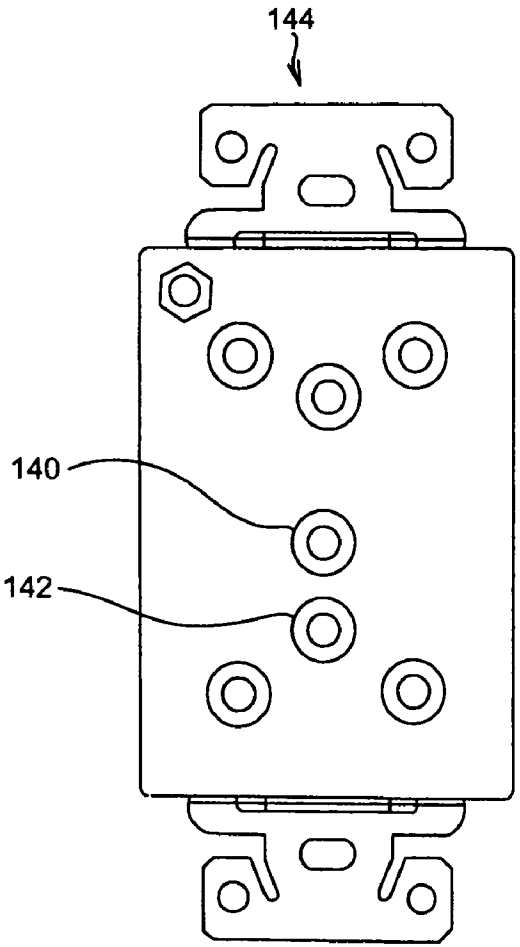
Figure 8B:
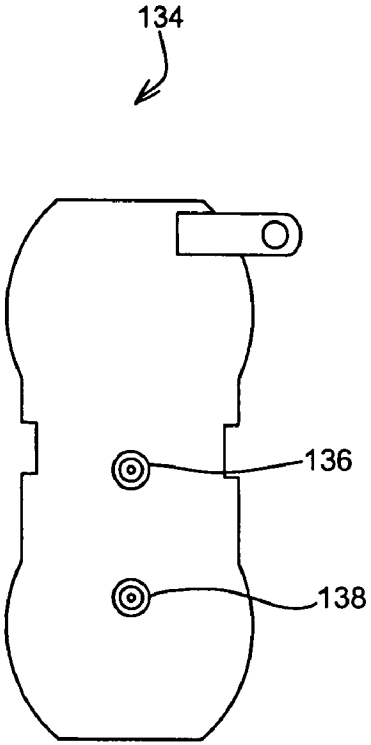
Figure 8A:
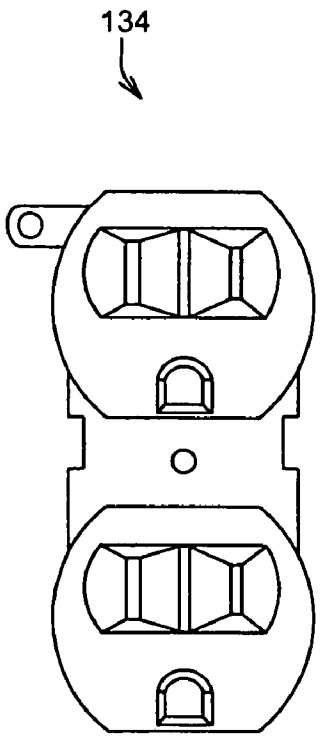
Figure 9:
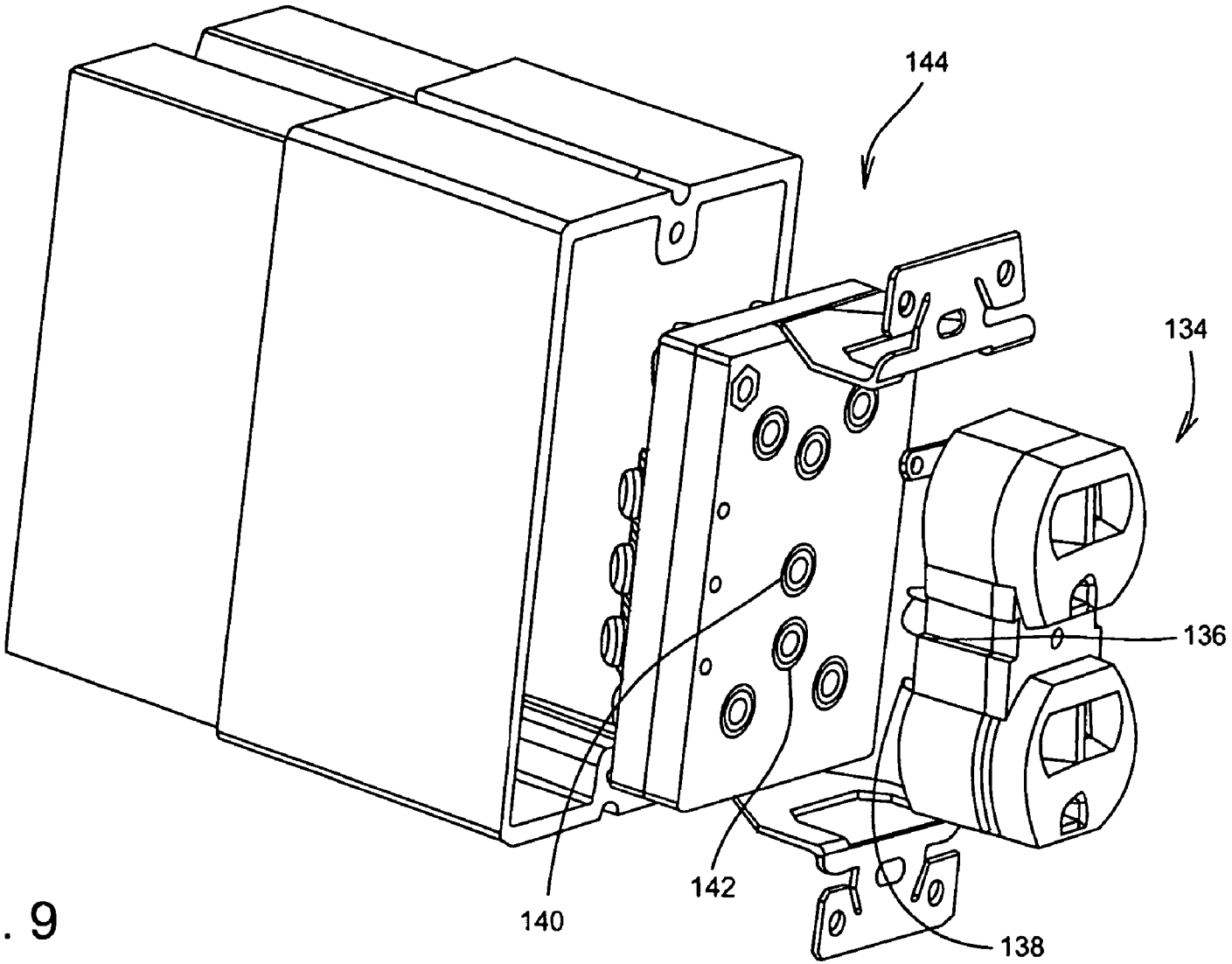
FIG. 9 is an exploded view of the assembly of a duplex receptacle with the single-gang module of FIGS. 1A-1C and with an electrical box.

It should be noted that switch 84 comprises two plate-shaped ground prongs, to enable the connection with the ground slot on module 98 regardless of whether the switch is employed in an upside position, as in FIG. 6A, or on an upside-down position, as in FIG. 6H.

A second module 102 is connected to a second switch 105, wherein a prong 106 is connected to a "load" slot 108, and prongs 110 and 112 to traveler slots 114 and 116 (in turn, connected to ports 120 and 118). A first traveler wire (typically, a red conductor wire) connects port 104 with port 118, and a second traveler wire (typically, a black conductor wire) connects port 100 to port 120, closing the circuit.

Figure 10D:
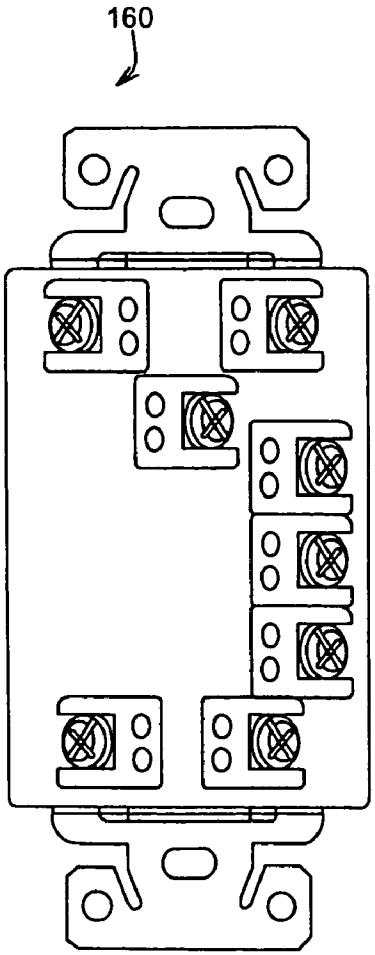
Figure 10C:
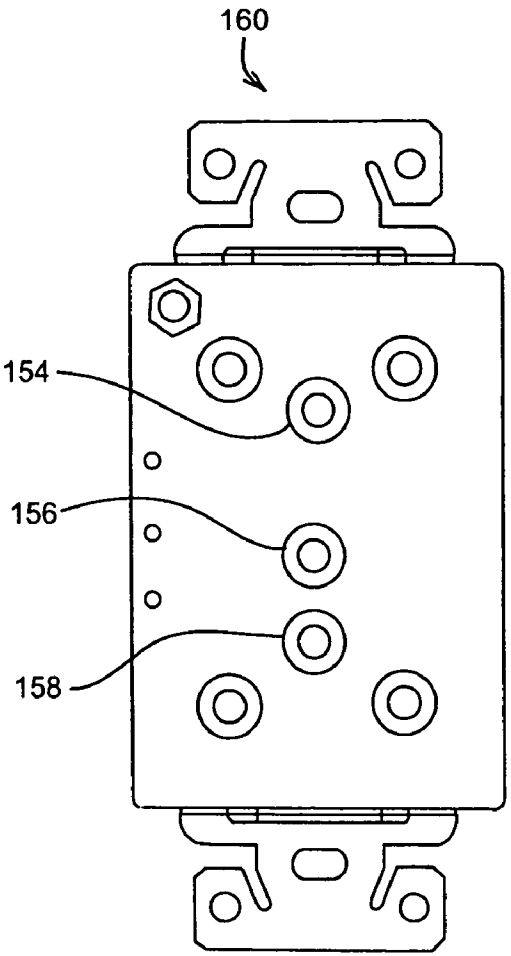
Figure 10B:
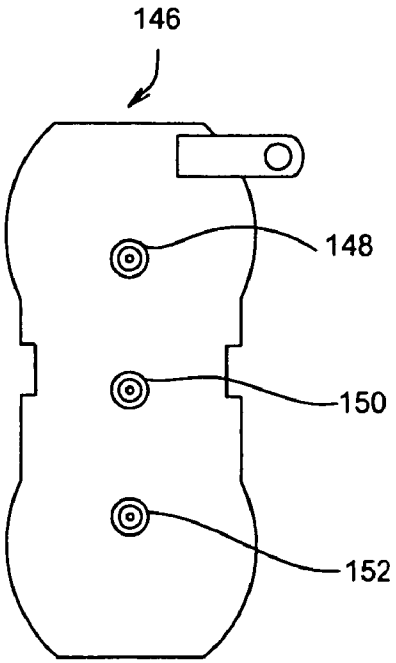
Figure 10A:
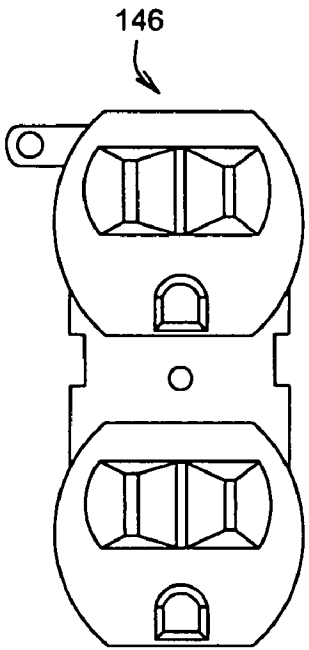
Figure 11D:
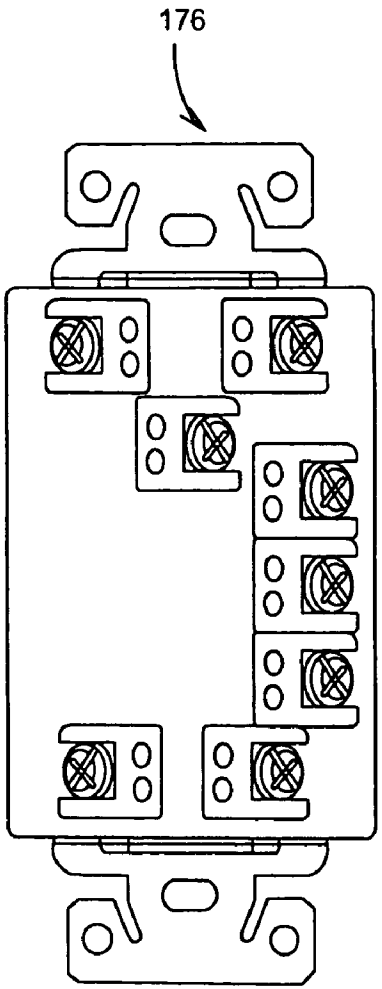
Figure 11C:
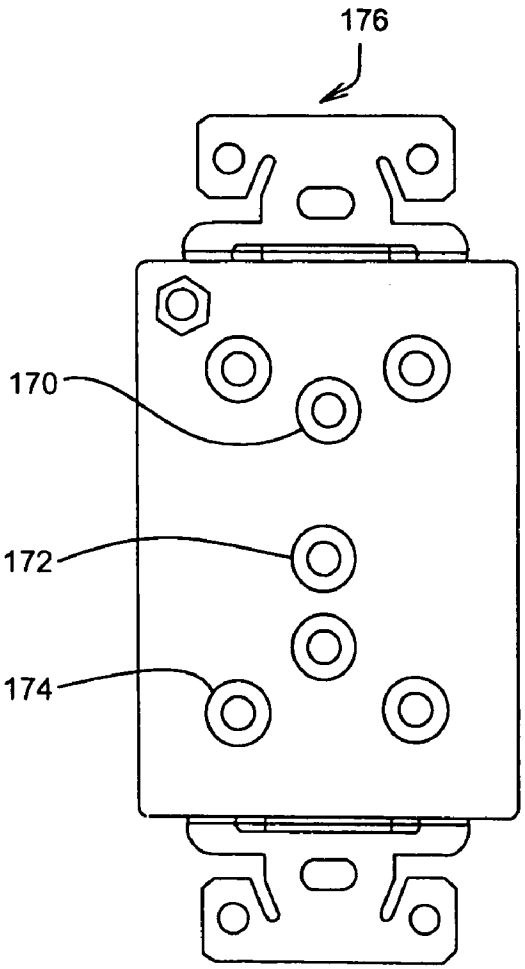
Figure 11B:
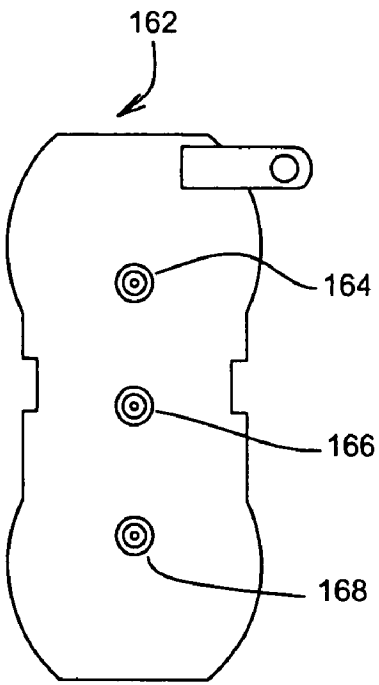
Figure 11A:
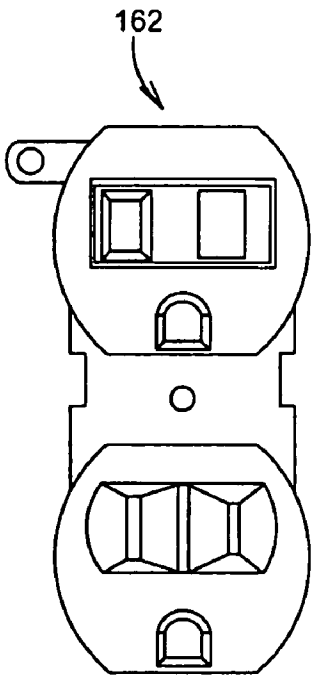

FIGS. 7A-7D, 8A-8D, 9, 10A-10D, and 11A-11D illustrate other exemplary, non-limiting applications of the first embodiment. In particular, FIGS. 7A-7D illustrate the application related to a single receptacle 122, wherein receptacle 122 (shown in FIG. 7A with a front view and in FIG. 7B with a rear view) has two prongs 124 and 126 extending from the rear side, and mating with slots 128 and 130 on module 132, and wherein slot 128 is a "neutral" slot and slot 130 is a "power" slot. Instead, FIGS. 8A-8D and 9 illustrate the application related to a duplex receptacle 134, wherein receptacle 134 has two prongs 136 and 138 mating with slots 140 and 142 on module 144, and wherein slot 140 is a neutral slot, and slot 142 is a power slot. Further, FIGS. 10-10D illustrate the application related to a half switch receptacle 146, wherein three prongs 148, 150, and 152 mate with three slots 154, 156, and 158 on module 160, and wherein slot 154 is a "load" slot, slot 156 is a "neutral" slot, and slot 158 is a "power" slot. Still further, FIGS. 11A-11D illustrate the application related to a single pole/receptacle 162, wherein three prongs 164, 166, and 168 mate with slots 170, 172, and 174 on a module 176, and wherein slot 164 is a "load" slot, slot 166 is a "neutral" slot, and slot 168 is a "power" slot.

While FIGS. 6A-6H illustrates a 3-way switch system, a 4-way switch system that still employs a plurality of universal electrical modules constructed according to the present embodiment is illustrated in FIGS. 12A-12L. A first switch 180 comprises three prongs 181, 182, and 183 extending from its rear face and disposed as shown. Prongs 181 and 182 mate with slots 185 and 186 on the front face of a first module 184, which are "traveler" slots, while prong 183 mates with slot 187, which is a "line" slot. In turn, slots 185 and 186 are connected with ports 188 and 189 on the rear face of first module 184.

Figures 12A, 12B, 12C, 12D, 12E, 12F, 12G, 12H, 12I, 12J, 12K, 12L:
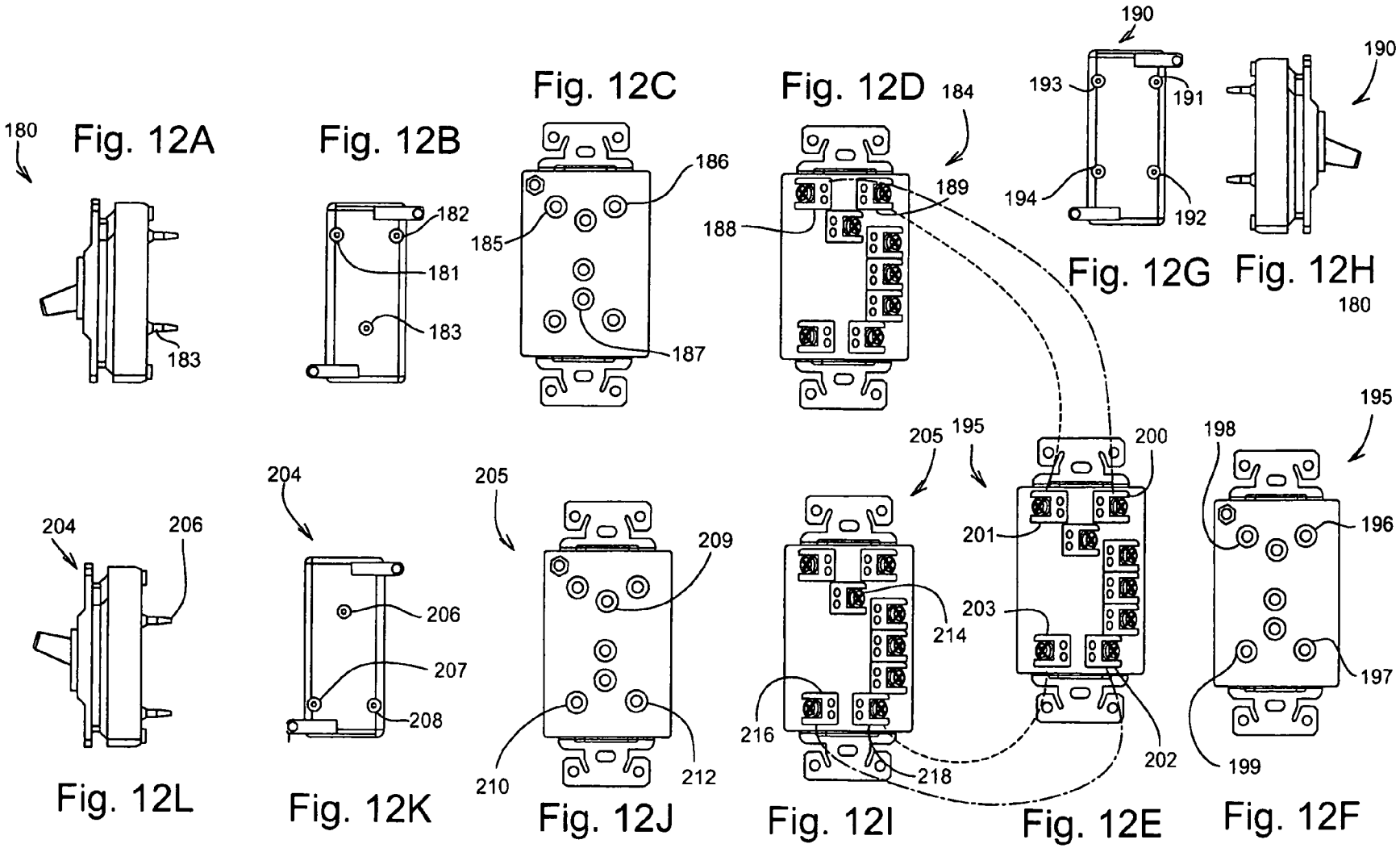

A second switch 190, having four prongs 191, 192, 193, and 194 disposed as illustrated, is connected to second module 195, wherein each of prongs 191, 192, 194, and 194 is mated with a traveler slot 196, 197, 198, and 198, as shown in FIGS. 12F-12G. In turn, traveler slots 196, 197, 198, and 199 are connected with traveler ports 200, 201, 202, and 202. Therefore, while both switches 180 and 190 operate as switches, their different position within the 4-way switch circuit provides for a different disposition of the prongs extending from each switch, in order to fit the relative position of each switch within the circuit, while the design of modules 184 and 195 is identical.

A third switch 204 is connected to a third module 205, wherein third switch 204 has three prongs 206, 207, and 207 extending from its rear face and mated with one load slot 209 and two traveler slots 210 and 212 on third module 205. Within third module 205, load slot 209 is connected with load port 214, and traveler slots 210 and 212 are connected with traveler slots 216 and 218. To close the circuit, a first traveler wire connect port 188 with port 201, and a second traveler wire (typically, both black conductor wires) connects port 203 with port 216. A third traveler wire connects port 189 with port 200, while a fourth traveler wire (typically, both red conductor wires) connects port 202 with port 218.

In other embodiments of the invention, the universal electrical module is built wider than a single gang, although still as a single component. As can be seen from FIGS. 13A-13D, 14A-14D, and 15A-15D, two equal or different electrical devices can be affixed to a universal electrical module 214 that is two gangs wide; three equal or different electrical devices can be affixed to a universal electrical module 216 that is three gangs wide, and four equal or different electrical devices can be affixed to a universal electrical module 218 that is four gangs wide.

Figure 13A:
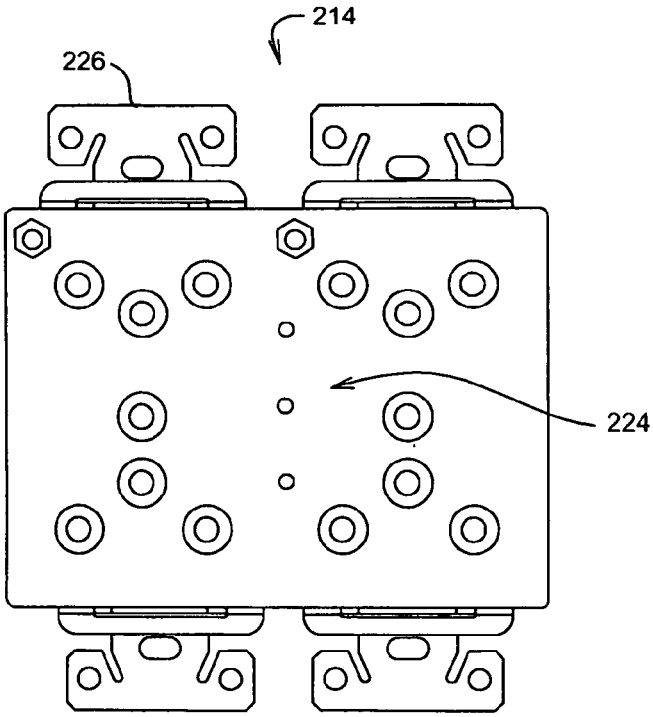
Figure 13B:
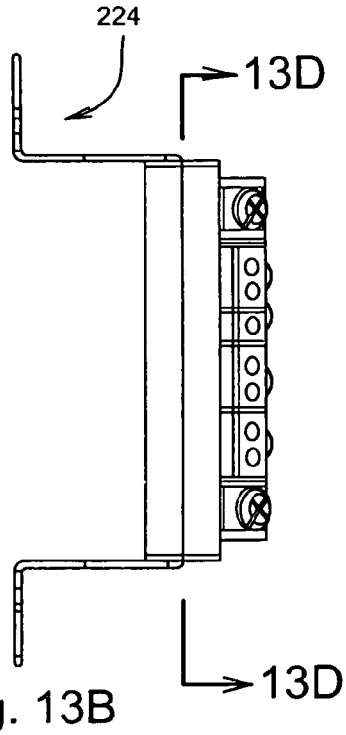
Figure 13C:
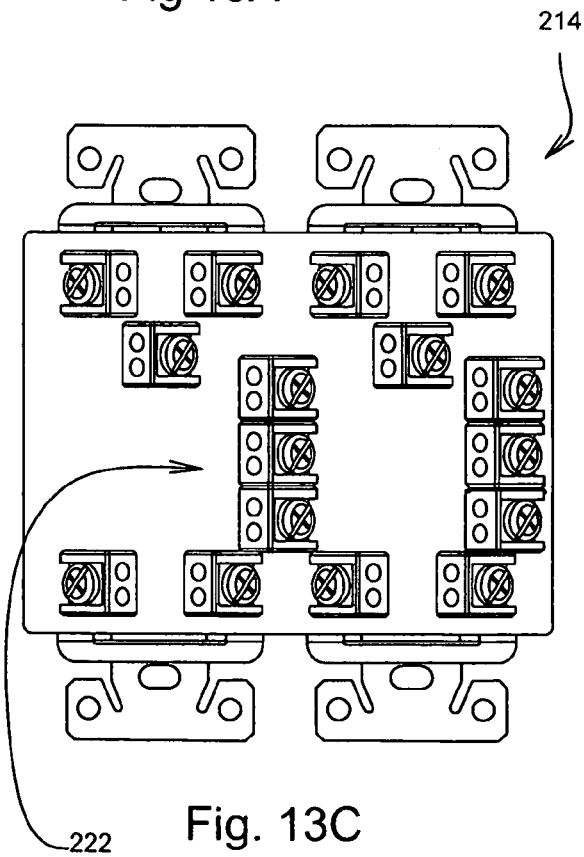
Figure 13D:
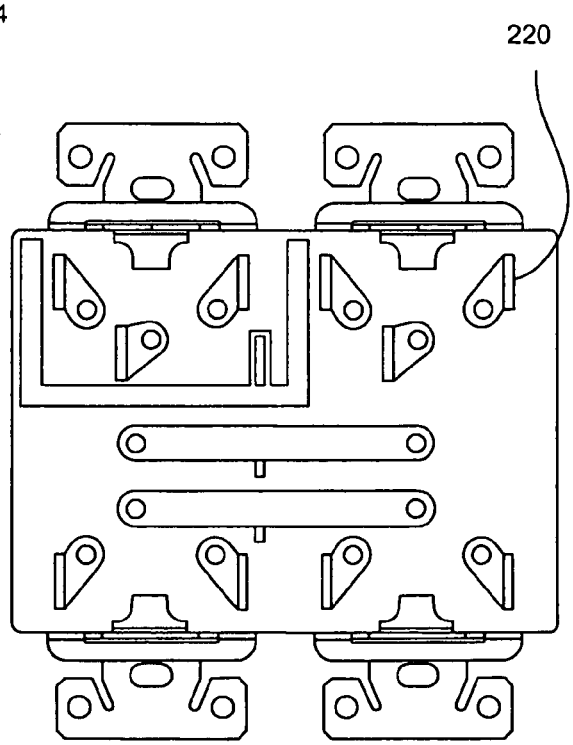

In particular, FIGS. 13A-13C show front, left side, and rear views of two-gang module 214, while FIG. 13D is a cross-section of two-gang module 214 (as seen from the front side) showing contact plates 220 that correspond to the slots on the front face of two-gang module 214. As shown in FIG. 13C, one or more busses are provided on the rear face of two-gang module 214, enabling line (or power), neutral, and ground connections in the same manner as for single gang module 10. Likewise, meter reading slots 224, corresponding to bus 222, are provided on the front face of two-gang module 214, as well as one or more retention plates 226, to affix the module to the electrical box. The slots on the front face of two-gang module 214 are arranged in two equal groups, each positioned on adjacent portions of the front face.

Figure 14A:
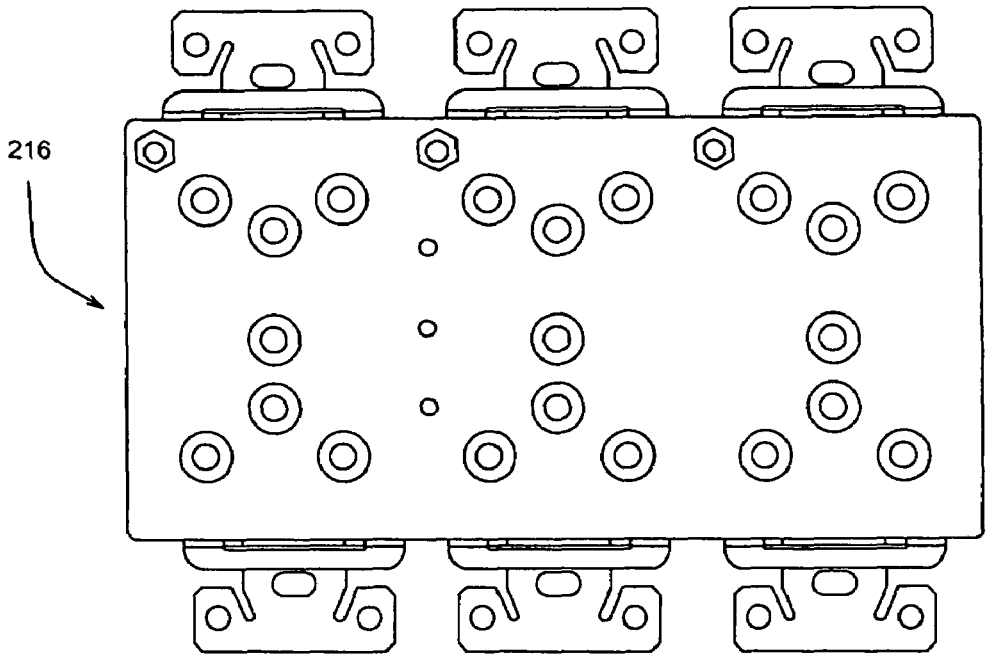
Figure 14B:
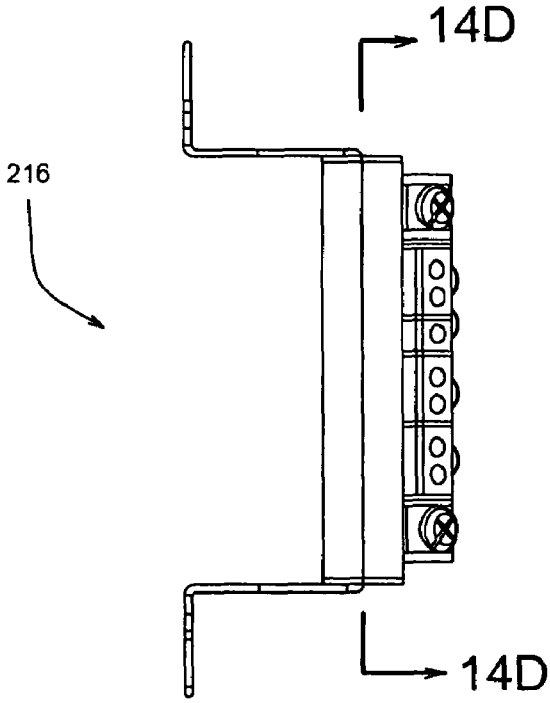
Figure 14C:
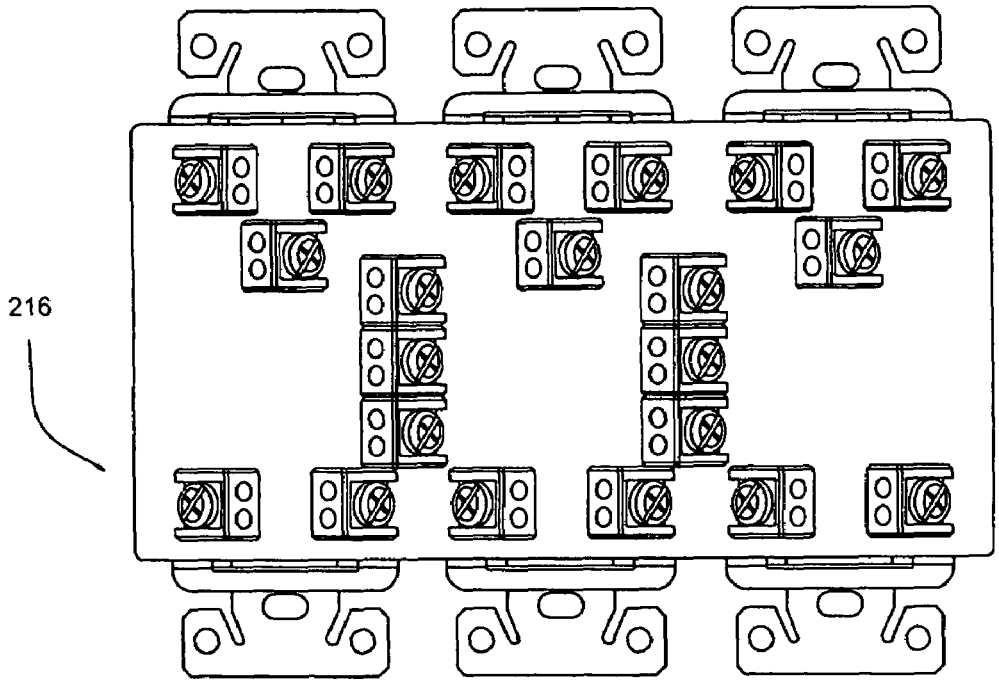
Figure 14D:
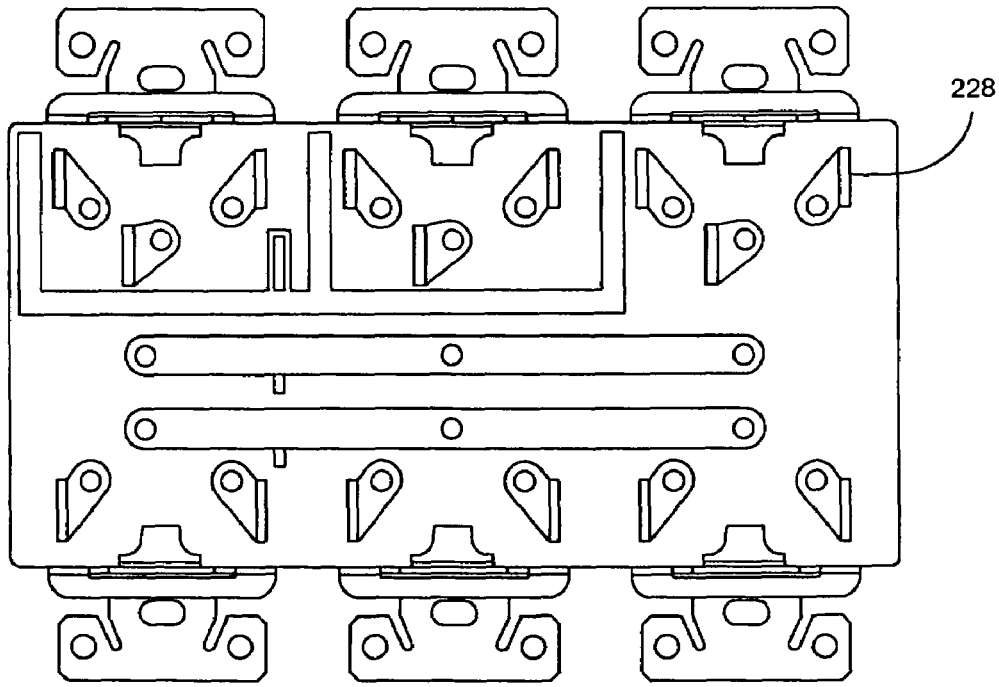
Figure 15A:
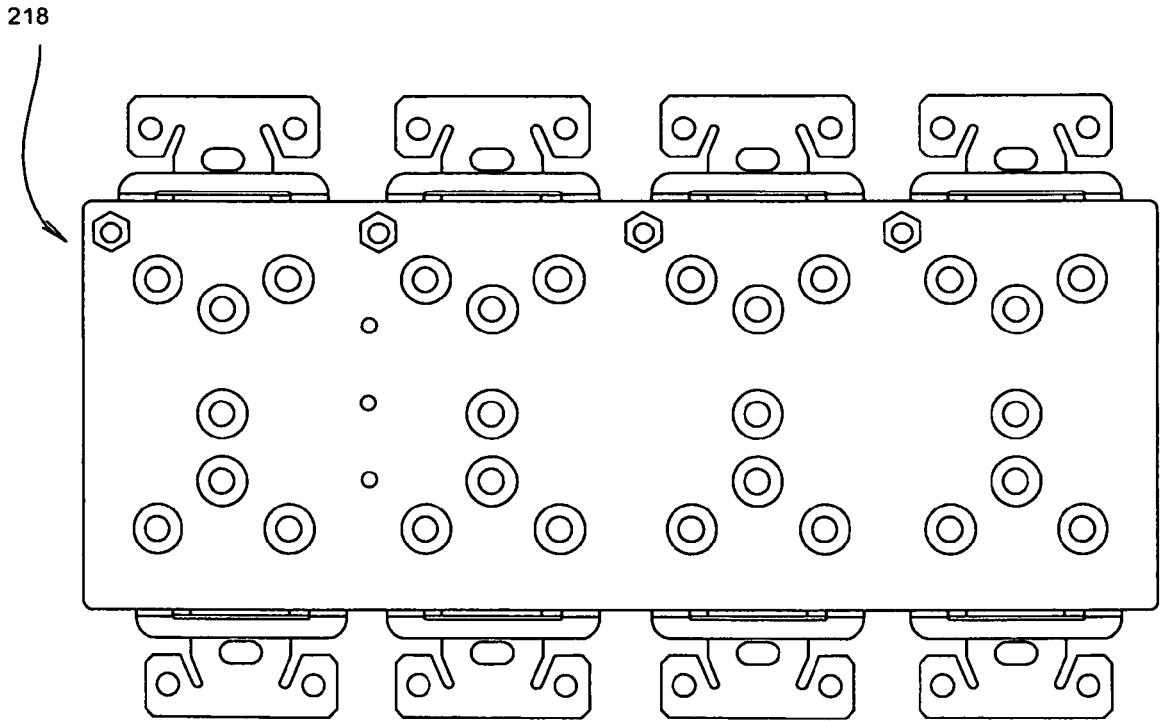
Figure 15B:
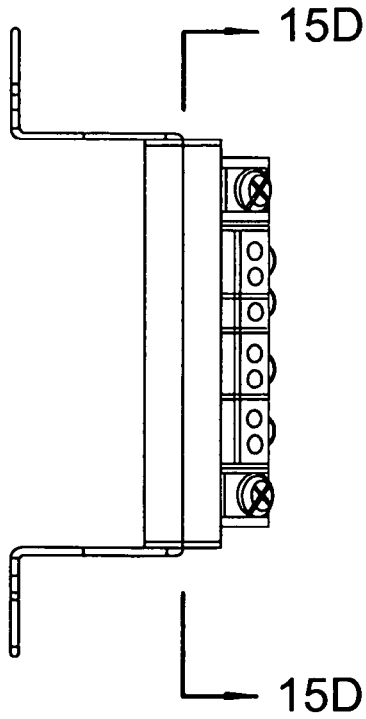
Figure 15C:
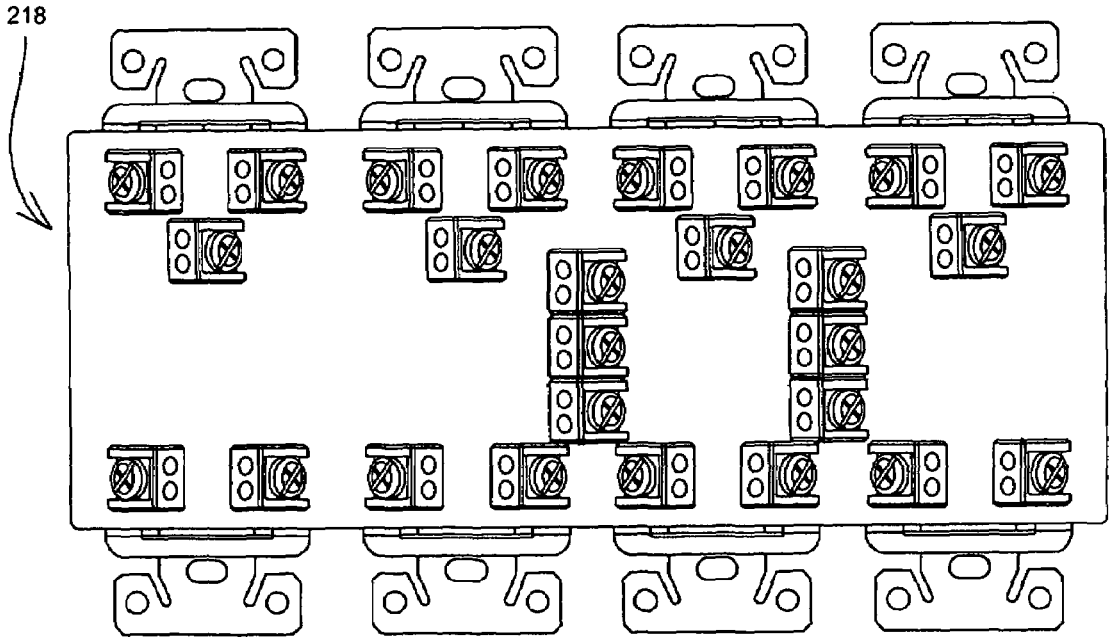
Figure 15D:
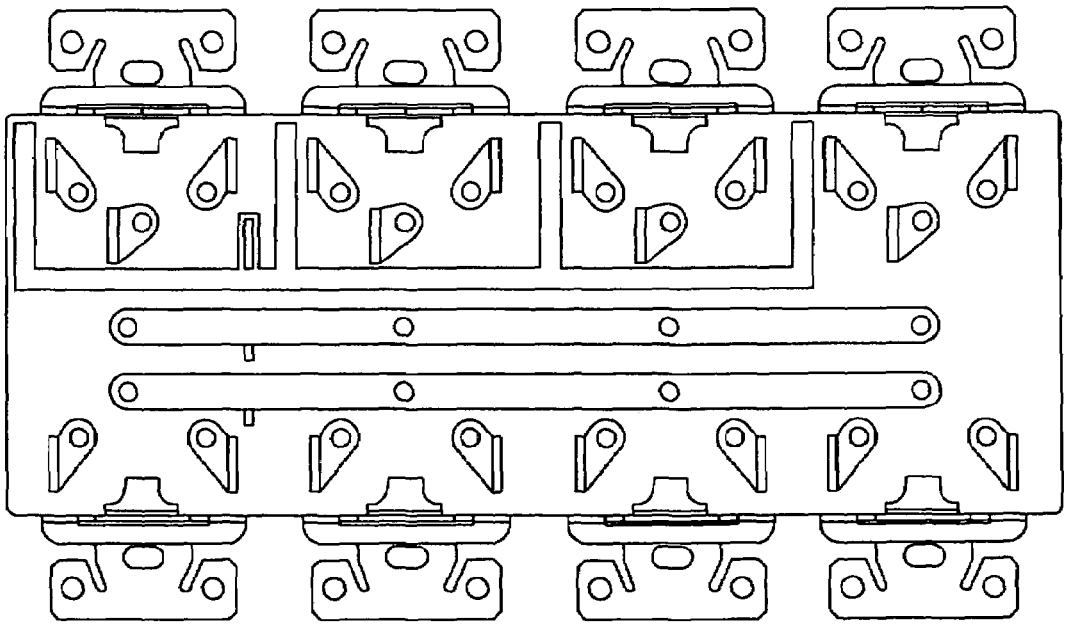

FIGS. 14A-14C show front, left side, and rear view of three gang module 216, while FIG. 14D shows a cross-section of three-gang module 216 illustrating in detail the arrangement of contact plates 228. Again, the slots on the front face of three-gang module 216 are arranged in three equal groups, each positioned on adjacent portions of the front face. Instead, FIGS. 15A-15C show front, left side, and rear view of four-gang module 218, while FIG. 15D shows a cross-section of four-gang module 218 illustrating in detail the arrangement of contact plates 230. Once more, the slots on the front face of four-gang module 218 are arranged in three equal groups, positioned on adjacent portions of the front face.

Covers (not shown in the drawings) may be provided that snap over the open face of an electrical box that houses a universal electrical module. These covers shield the universal electrical module during wallboard installation, prior to installation of the desired electrical device.

A person skilled in the art will recognize from the foregoing that the present invention generates significant time savings during electrical installations in buildings, because the times required to install the different types of electrical devices are significantly reduced. It will be further recognized that the present invention eliminates the need for twist on wire connectors such as WIRE-NUT® brand twist on wire connectors, and for jumper wires during building construction, and that the safety of operators will be enhanced by reducing the possibility of human errors. Still further, it will be recognized that the present invention is suitable for use with all existing U.S. electrical boxes, wires, and wiring methods, and complies with present building codes.

Although these techniques and structures have been disclosed in the context of certain embodiments and examples, it will be understood by those skilled in the art that these techniques and structures may be extended beyond the specifically disclosed embodiments to other embodiments and/or uses and obvious modifications and equivalents thereof. Thus, it is intended that the scope of the structures and methods disclosed herein should not be limited by the particular disclosed embodiments described above.

What is claimed is:

1. A universal electrical module comprising:

a housing having a first face and a second face, said first face comprising a plurality of slots, said second face comprising a bus and a plurality of ports; and a retention system extending from said housing and shaped to retain said universal electrical module within an electrical box;

wherein said bus comprises a power-carrying bus portion, a neutral bus portion, and a ground bus portion, wherein each of said power-carrying bus portion, said neutral bus portion, and said ground bus portion, and each of said ports is structured for connection to a conductor wire, wherein at least one of said slots creates a contact with said power-carrying bus portion, at least one of said slots creates a contact with said neutral bus portion, at least one of said slots operates as a ground slot creating a contact with said ground bus portion, and the remaining slots each create a contact with one of said ports, wherein each of said slots is structured for mating with a prong extending from an electrical device;

a meter reading row provided on said first face, wherein said meter reading row comprises a plurality of reading slots each connected to one of said power-carrying bus portion, said neutral bus portion, and said ground bus portion, and wherein each of said reading slots is suitable for access by a measuring instrument;

wherein said universal electrical module is a single-gang module structured for connecting to a single electrical device, wherein said first face comprises eight slots and said second face comprises one bus and five ports; and wherein said slots creating contacts with said bus portions are aligned in a central position on said first face, and wherein said slots connected to said ports are arranged in two groups on the periphery of said first face, said two groups being positioned opposite to each other.

2. The universal electrical module according to claim 1, wherein said retention system comprises one or more L-shaped retention plates having a first end connected to said housing and a second end connected to an open edge of said electrical box.

3. The universal electrical module according to claim 1, wherein the prong connected to said ground slot is plate-shaped, and wherein said plate-shaped prong and said ground slot are connected to each other with a screw.

4. An electrical device for use with the electrical module constructed according to claim 1, comprising a plurality of prongs extending from said electrical device, wherein each of said prongs is structured to mate with one of a plurality of slots on an electrical module, and wherein each of said plurality of slots provides access to a source selected from the group consisting of power, load, neutral, and ground; and wherein said prongs for mating with said slots are aligned in a central position on an inner face, and wherein said prongs for mating with said slots connected to said ports are arranged in two groups on the periphery of said inner face, said two groups being positioned opposite to each other.

5. The electrical device according to claim 4, wherein one prong is a ground prong, wherein said ground prong is plate-shaped, and wherein said ground prong is structured to connect to a ground slot with a screw.

6. The electrical device according to claim 4, wherein said electrical device is a single pole switch having a first prong to connect to a source of power, a second prong to connect to a source of source of load, and a third prong to connect to a source of ground.

7. The universal electrical module according to claim 1, wherein said universal electrical module is a multiple-gang module structured for connecting to a plurality of electrical devices, wherein said first face comprises multiple slots and said second face comprises multiple bus and multiple ports, and wherein at least two or more of said slots creates a contact with said power-carrying bus portions, two or more of said slots creates a contact with said neutral portions, two or more of said slots is a ground slot creating a contact with said ground bus portions, and the remaining slots each create a contact with two or more of said ports.

8. The universal electrical module according to claim 7, wherein said universal electrical module is a multiple-gang module and includes a two-gang module.

9. The universal electrical module according to claim 7, wherein said universal electrical module is a multiple-gang module and includes a three-gang module.

10. The universal electrical module according to claim 7, wherein said universal electrical module is a multiple-gang module and includes a four-gang module.

11. The method for making a universal electrical module according to claim 7, wherein said universal electrical module is a multiple-gang module and includes a two-gang module.

12. The method for making a universal electrical module according to claim 7, wherein said universal electrical module is a multiple-gang module and includes a three-gang module.

13. The method for making a universal electrical module according to claim 7, wherein said universal electrical module is a multiple-gang module and includes a four-gang module.

14. A method for making a universal electrical module, comprising the steps of:

(a) providing a housing having a first face and a second face, said first face comprising a plurality of slots, each of said slots being structured for mating with a prong extending from an electrical device, said second face comprising a bus and a plurality of ports, said bus comprising a power-carrying bus portion, a neutral bus portion, and a ground bus portion, each of said power-carrying bus portion, a neutral bus portion, and said ground bus portions and each of said ports being structured for connection to a conductor wire;

(b) providing a retention system extending from said housing and shaped to retain said universal electrical module within an electrical box; and (c) causing at least one of said slots to create a contact with said power-carrying bus portion, at least one of said slots to create a contact with said neutral bus portion, at least one of said slots to create a contact with said ground bus portion, and the remaining slots each to create a contact with one of said ports;

(d) providing a meter reading row on said first face, said meter reading row comprising a plurality of reading slots each connected to one of said bus portions, each of said reading slots being suitable for access by a measuring instrument;

(e) arranging said slots on said first face as one or more identical gangs, each of said gangs being structured for connection to one electrical device, further comprising the step of providing one bus on said second face and of arranging said plurality of ports shaped as one or more identical gangs; and (f) providing an electrical device comprising a plurality of prongs extending from said electrical device, wherein each of said prongs is structured to mate with one of a plurality of slots on an electrical module, and wherein each of said plurality of slots provides access to a source selected from the group consisting of power, load, neutral, and ground.

15. The method for making a universal electrical module according to claim 14, further wherein said universal electrical module is a multiple-gang module structured for connecting to a plurality of electrical devices, wherein said first face comprises multiple slots and said second face comprises multiple bus and multiple ports, and wherein at least two or more of said slots creates a contact with said power-carrying bus portions, two or more of said slots creates a contact with said neutral bus portions, two or more of said slots is a ground slot creating a contact with said ground bus portions, and the remaining slots each create a contact with two or more of said ports.

* * * * *